United States Patent [19]

Pischke et al.

[11] Patent Number: 4,573,440

[45] Date of Patent: Mar. 4, 1986

[54] METHOD FOR LIMITING THE SPEED OF AN INTERNAL COMBUSTION ENGINE IN A VEHICLE AND DEVICE FOR SAME

[75] Inventors: Reiner Pischke, Bad Friedrichshall; Karl-Heinz Köhler, Ingolstadt, both of Fed. Rep. of Germany

[73] Assignee: Audi NSU Auto Union Aktiengesellschaft, Fed. Rep. of Germany

[21] Appl. No.: 743,280

[22] Filed: Jun. 11, 1985

Related U.S. Application Data

[63] Continuation of Ser. No. 543,417, Oct. 19, 1983, abandoned.

[30] Foreign Application Priority Data

Oct. 22, 1982 [DE] Fed. Rep. of Germany ..... 3239052

[51] Int. Cl.[4] ..... F02M 51/00

[52] U.S. Cl. ..... 123/333; 123/350; 123/378; 123/332; 123/334

[58] Field of Search ..... 123/333, 350, 478, 493, 123/332, 353, 397, 422, 425, 492

[56] References Cited

U.S. PATENT DOCUMENTS

| | | | |
|---|---|---|---|
| 3,817,229 | 6/1974 | Stumpp | 123/332 |
| 4,075,988 | 2/1978 | Kato | 123/333 |
| 4,244,334 | 1/1981 | Maisch | 123/332 |
| 4,285,314 | 8/1981 | Kiencke et al. | 123/333 |
| 4,335,696 | 6/1982 | Schnürle et al. | 123/493 |
| 4,367,716 | 1/1983 | Yasuhara | 123/478 |
| 4,383,514 | 5/1983 | Fiala | 123/493 |
| 4,385,617 | 5/1983 | Nakato et al. | 123/334 |
| 4,391,243 | 7/1983 | Bessho | 123/493 |
| 4,469,073 | 9/1984 | Kobayashi et al. | 123/493 |
| 4,480,621 | 11/1984 | Höppel | 123/493 |
| 4,489,696 | 12/1984 | Kobayashi et al. | 123/493 |

*Primary Examiner*—Raymond A. Nelli

*Attorney, Agent, or Firm*—Kane, Dalsimer, Kane, Sullivan and Kurucz

[57] ABSTRACT

In an externally ignited internal combustion engine for a vehicle with an electronic device for controlling the gas mixture composition and the point of ignition a leaner fuel-air mixture and the an earlier point of ignition is set before the maximum permissible speed is attained. The reduction of power of the combustion engine caused thereby shows the driver that the speed of the combustion engine approaches the maximum permissible speed at which the fuel supply and the ignition will be interrupted. This should cause the driver to release the gas pedal or switch into the next higher gear.

6 Claims, 2 Drawing Figures

METHOD FOR LIMITING THE SPEED OF AN INTERNAL COMBUSTION ENGINE IN A VEHICLE AND DEVICE FOR SAME

This is a continuation of co-pending application Ser. No. 543,417 filed on Oct. 19, 1983, now abandoned.

BACKGROUND OF THE INVENTION

This invention is related to a process for limiting the speed of an externally ignited, internal combustion engine and a device for performing the process.

The presently known processes for limiting the speed of externally ignited combustion engines have various disadvantages which affect the driveability and the exhaust characteristics of the vehicle being powered by said engine. For example shutting off of the fuel supply when reaching a predetermined highest speed can result in dangerous conditions if it occurs while another vehicle is being passed. Furthermore if the fuel is shut off while high acceleration is taking place in a low gear, it results in a high braking force on the vehicle. The same is true if the engine speed is limited by interrupting the ignition circuit.

It is further known from German Pat. DE-OS No. 24 14 298 that another method of speed limiting comprises eliminating alternate ignition pulses when a predetermined high speed is reached thereby eliminating the abrupt shutting off of the combustion engine. However, this results in a rough running of the engine which in turn causes excessive stresses on the transmission elements such as, for example, the drive shaft. Furthermore if the combustion engine is provided with an exhaust gas catalyst, the danger of overheating the catalyst exists because of the combustion of the unburned fuel which comprise the exhaust gases.

OBJECTIVES AND SUMMARY OF THE INVENTION

It is therefore an object of the invention to provide a process for limiting the speed of an externally ignited internal combustion engine in a vehicle wherein an abrupt shutting off of the combustion engine and the associated disadvantageous effects thereof due to the combustion of the exhaust gases are eliminated.

This object of the invention is obtained in that at a predetermined speed, the amount of fuel in the fuel-air mixture supplied to the combustion engine is reduced and simultaneously an earlier ignition point is set before the engine reaches the maximum permissible speed requiring that fuel supply and/or the ignition circuit be interrupted.

The invention permits the power of the combustion engine to be gradually reduced before reaching the predetermined maximum speed, even if, for example the gas pedal is completely pushed down. If the driver does not release the gas pedal, despite of the noticeable power reduction, or if he does not switch to a higher gear, the combustion engine switches off, said switching off occuring at lower speeds than in the prior art devices. Due to the simultaneous setting of the ignition to an earlier ignition point, the increase of the exhaust temperature during a lean operation is prevented thereby preventing possible endangerment of the exhaust gas catalyst.

The process can be applied without any great expense in an internal combustion engine equipped with an electronic control device, since this control device already contains the necessary control means. For example if the maximum permissible speed is, for example, 7,000 RPM, at 6,000 RPM, the fuel supply is reduced by about 25% by means of the control device and simultaneously, the ignition point is advanced to approximately about 50° before top dead center. The reduction of the fuel amount in a fuel injection combustion engine is attained by a corresponding shortening of the duration of the injection.

Preferably, the electronic control device contains a knocking sensor and/or a lambda sensor for determining the exhaust gas composition, so as to eliminate damage to the combustion engine or to maintain the poisonous components in the exhaust gas within permissible limits during the engine's operation between the predetermined speed and the maximum speed. Such a control device with knocking sensor and lambda sensor is described for example in German Pat. DE-OS No. 29 29 907.

DETAILED DESCRIPTION OF THE PREFERRED EMBODIMENT

Figure 1:
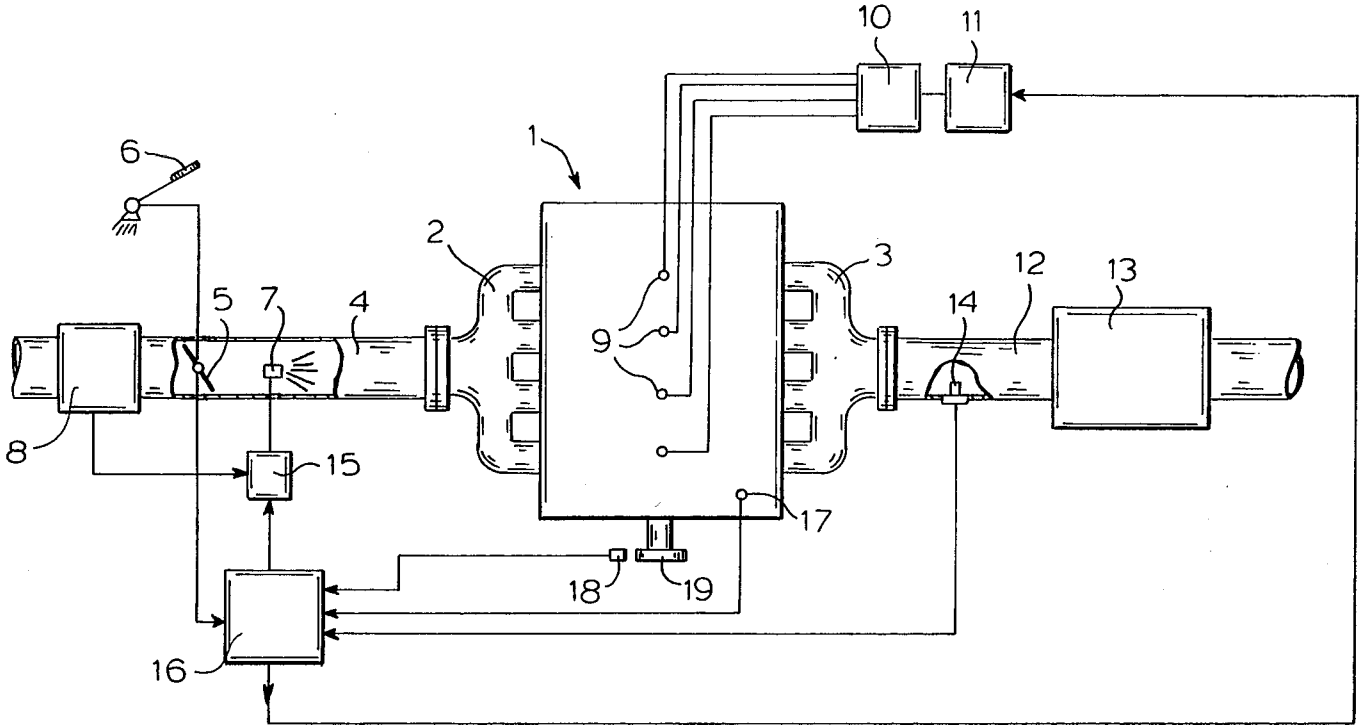
FIG. 1 shows schematically an externally ignited internal combustion engine having an electronic ignition controller and FIG. 2 shows a flow chart for the electronic control device of FIG. 1.

In the following the invention will be explained in more detail in accordance with the attached drawing in which an externally ignited, internal combustion engine in a vehicle 1 is illustrated which is provided with an intake manifold 2 and an exhaust manifold 3. A throttle valve 5 is provided in the intake pipe 4 which can be actuated by means of a gas pedal 6. The intake pipe 4 also contains a fuel injection nozzle 7 and an air metering device 8. The spark plugs 9 are connected with a distributor 10 which is connected with a device 11 for setting the ignition point. A catalyst 13 and an oxygen probe 14 are mounted in the exhaust pipe 12 which is disposed downstream of the exhaust manifold 3.

A fuel metering device 15 is in connection with the air metering device 8 and it normally feeds an amount of fuel to the fuel injection nozzle 7 which is proportional to the air intake.

An electronic control device 16 receives input signals from the oxygen probe 14, from a knocking sensor 17 which is mounted on the engine block and from a speedometer 18 which determines the speed of the crankshaft 19 of combustion engine 1. Furthermore, the control device 16 receives signals from the position of the throttle valve 5 which is proportional to the torque developed by the combustion engine. The outputs of the control device 16 is connected to the fuel metering device 15 and also the device 11 for changing the ignition point. A typical performance map of the engine is stored in the control device 16 which defines for each operating point of the combustion engine 1 the optimum amount of fuel and the optimum ignition point. The control device 14 controls the devices 11 and 15 in accordance to said map. A corresponding signal is sent to the control device 16 by the knocking sensor 17 when reaching the knocking limit, whereby the control device causes the device 11 to set the ignition point in a delayed manner. The oxygen probe 14 is used to enable the control device 16, under normal operating conditions, to provide a stoichiometric fuel-air ratio.

When the speed of the combustion engine 1 exceeds a certain value, for example, 6000 rotations per minute, as indicated by a corresponding signal from the speedometer 18, the fuel metering device 15 is adjusted by the control device 16 to gradually reduce the fuel amount and simultaneously the ignition point setting device 11 is adjusted to an earlier ignition point. Thereby, the power of the combustion engine 1 is reduced. If the speed of the combustion engine 1 increases further because the driver did not release the gas pedal 6, a signal is sent from the control device 16 to the fuel metering device 15 to interrupt the fuel supply to the injection nozzle 7 and to the ignition point setting device 11 to interrupt the ignition circuit before reaching the maximum permissible speed.

Figure 2:
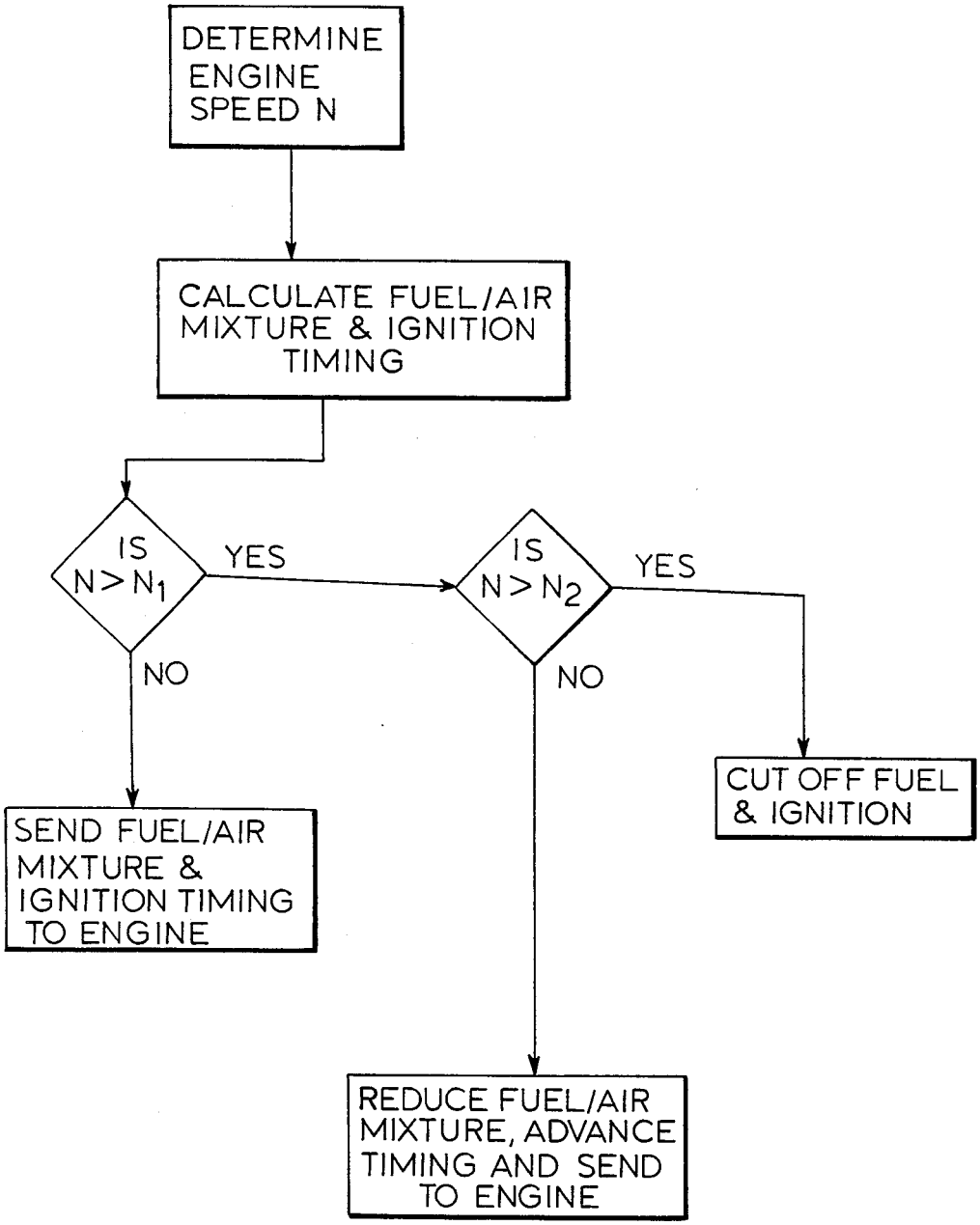

The invention may be implemented as shown in FIG. 2. Control device 16 receives two variables M and n. Variable M is indicative of the volume of air entering intake pipe 4 and is derived either from the position of throttle valve 5 or from the air metering device 8.

Variable n is the instantaneous rotational speed of the engine as determined by speedometer 18.

Control device 16 contains in its memory two maps (a) and (b). Map (a) indicates the optimum injection point BTDC (before top dead center) for the engine as a function of M/n and n. Map (b) indicates the optimum amount of fuel, i.e., the activation time Ti of fuel injection nozzle 7 as a function of M/n and n. The control device generates two signals IP and Ti corresponding to maps (a) and (b) respectively. If n is less than a preset limit $n_1$ (for example, 6,000 RPM), then IP and Ti are sent to devices 11 and 15 respectively.

If n reaches $n_1$, then IP and Ti are adjusted, as shown by using the formulas:

$$IP_c = IP \cdot K_1 \cdot n/n_1$$

and $$Ti_c = Ti \cdot K_2 \cdot n/n_1.$$

where $K_1$ and $K_2$ are present constants.

If n exceeds $n_1$ for a relatively long time, or if n reaches a maximum limit $n_{max}$ then an interrupt signal is sent to device 15. As a result, the amount of fuel in the fuel/air mixture is reduced making the mixture leaner and the ignition point is advanced to protect the exhaust gas catalyst 13 from overheating.

What is claimed is:

1. A method for limiting the speed of an externally ignited fuel-injected internal combustion engine having a control device for generating a first optimized signal for controlling the fuel/air mixture fed into said engine and for generating a second optimized signal for setting the injection timing in accordance with the operational parameters of the engine, comprising:

monitoring the speed of rotation of said engine; and simultaneously modifying said first and second optimized signals to reduce the amount of fuel in said fuel mixture and to advance said injection timing when said speed of rotation exceeds a first predetermined speed to reduce the power of the engine.

2. The process in accordance with claim 1, characterized in that the amount of fuel is continuously reduced from the point said predetermined speed is attained.

3. The process in accordance with claim 1, characterized in that the amount of fuel is immediately reduced to about 25% when reaching the predetermined speed.

4. The process in accordance with one of claims 1 to 3, characterized in that the ignition timing is advanced to approximately 50° before top dead center when reaching the predetermined speed.

5. The method of claim 1 further comprising interrupting the fuel flow to said engine when said speed of rotation reaches a second predetermined speed higher than said first predetermined speed.

6. The method of claim 1 further comprising interrupting the ignition when said speed of rotation reaches a second predetermined speed higher than said first predetermined speed.

* * * * *